United States Patent [19]

Claar et al.

[11] Patent Number: 4,593,544

[45] Date of Patent: Jun. 10, 1986

[54] CENTRAL LOCKING SYSTEM WITH TWO-DOOR CONTROL FOR MOTOR VEHICLES

[75] Inventors: Klaus Claar, Freudenstadt; Klaus-Juergen Heimbrodt, Boeblingen; Hermann Kurth, Sindelfingen, all of Fed. Rep. of Germany

[73] Assignee: Daimler-Benz Aktiengesellschaft, Fed. Rep. of Germany

[21] Appl. No.: 447,100

[22] Filed: Dec. 6, 1982

[30] Foreign Application Priority Data

Dec. 11, 1981 [DE] Fed. Rep. of Germany ..... 3149071

[51] Int. Cl.[4] ..... E05B 65/36

[52] U.S. Cl. ..... 70/264; 70/277; 180/289

[58] Field of Search ..... 70/264, 275, 277; 180/289

[56] References Cited

U.S. PATENT DOCUMENTS

| | | | |
|---|---|---|---|
| 3,630,305 | 12/1971 | Kazaoka | 70/264 X |
| 3,633,391 | 1/1972 | Andres et al. | 70/264 |
| 4,181,191 | 1/1980 | Hoffman et al. | 70/264 X |
| 4,240,516 | 12/1980 | Henderson et al. | 180/289 |
| 4,253,319 | 3/1981 | Feichtiger et al. | 70/264 |

FOREIGN PATENT DOCUMENTS

| | | | |
|---|---|---|---|
| 3008272 | 9/1981 | Fed. Rep. of Germany | 70/275 |
| 1577210 | 11/1980 | United Kingdom | 70/264 |
| 2069583 | 8/1981 | United Kingdom | 70/264 |

*Primary Examiner*—Robert L. Wolfe
*Assistant Examiner*—Lloyd A. Gall
*Attorney, Agent, or Firm*—Craig & Burns

[57] ABSTRACT

A central locking system with a two-door control for motor vehicles, in which certain locking operations are precluded in dependance on the position of the key of a starter switch of the driving engine. In order to prevent an unintentional locking of the vehicle doors under certain operating conditions, means are provided according to the present invention which enable a locking actuation of the central locking system exclusively by the interior actuating element of the driver door on the steering column side when the key is in the starter whereas only a mechanical locking of the individual front door on the passenger side is possible by way of the interior actuating element of this passenger door.

3 Claims, 1 Drawing Figure

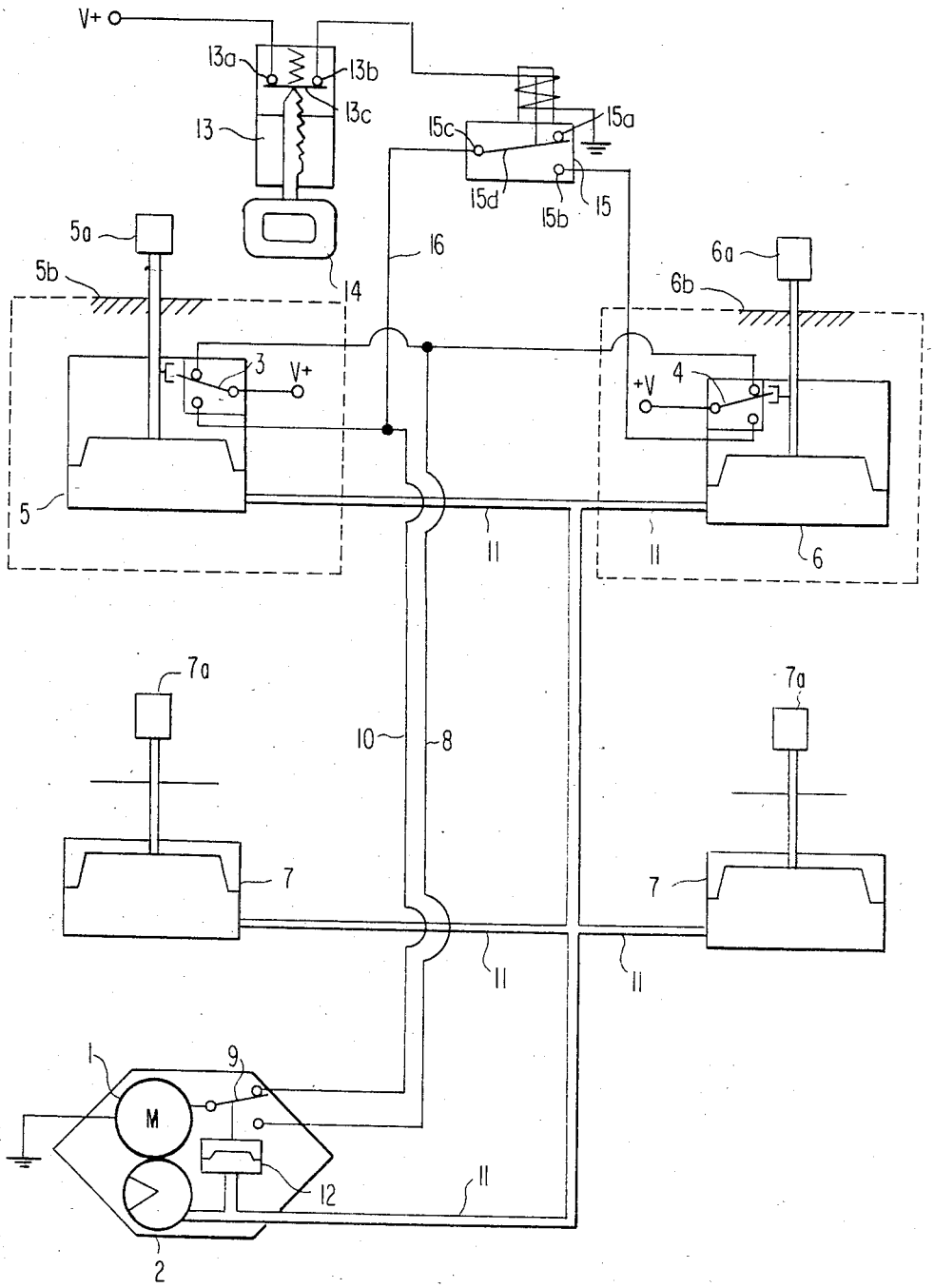
V+
13a
13b
13c
13
14
15a
15c
15d
15b
15
16
5a
5b
6a
6b
3
V+
+V
4
5
6
11
7a
10
8
7
1
9
M
12
2

CENTRAL LOCKING SYSTEM WITH TWO-DOOR CONTROL FOR MOTOR VEHICLES

BACKGROUND OF THE INVENTION

The present invention relates to a central locking system with two-door control for motor vehicles, in which certain locking operations are precluded in dependence on the position of the key of a starter switch of the driving engine.

A central locking system for motor vehicles is described in the German Offenlegungsschrift No. 27 30 387 in which, when the ignition key is in the ignition lock, no actuation of the central locking system is possible by way of the interior locking knobs of all doors. This, however, entails the disadvantage that, for example, during a night-drive through remote areas, the driver cannot lock the vehicle for his safety from the inside by way of the central locking system.

On the other hand, the situation may arise with vehicles which include a central locking system with two-door control that the driver—without removing the ignition key—has left the vehicle for a short period of time, and the passenger who is also leaving the vehicle, locks the entire vehicle by way of the locking knob of the front passenger door. In order to avoid this, vehicles are already known which do not possess a locking knob at the passenger door which, however, signifies a considerable loss in comfort.

The present invention is therefore concerned with the task to avoid these disadvantages of the known prior art arrangements and to preclude, without loss in comfort, the described possibility of an inadvertent vehicle lock-out.

SUMMARY OF THE INVENTION

The underlying problems are solved according to the present invention in that means are provided which, with a key in the starter switch, enable a locking actuation of the central locking system exclusively by way of the inside actuating element of the driver door on the steering column side whereas only a mechanical locking of the individual front door on the passenger side is possible by way of the interior actuating element of this door.

These and other objects, features and advantages of the present invention will become more apparent from the following description when taken in connection with the accompanying drawing which shows, for purposes of illustration only, one embodiment in accordance with the present invention, and wherein:

BRIEF DESCRIPTION OF THE DRAWING

The single FIGURE is a schematic view of a central locking system in accordance with the present invention.

DESCRIPTION OF ILLUSTRATIVE EMBODIMENT

The central locking system for the doors of a motor vehicle (not shown) which is illustrated in the single FIGURE of the drawing, operates pneumatically according to the so-called bi-pressure system, i.e., it is supplied by way of an air pump 2 driven by an electric motor 1 which is able to supply both excess pressure and also vacuum. Since such electrically driven air pumps are known in the prior art, a detailed description thereof is dispensed with herein.

An operating element 5 and 6 equipped with an electric switch 3 and 4 is thereby provided for each of the driver and front passenger doors whereas exclusively working elements 7 without switches are necessary for the rear doors of the motor vehicle. The switches 3 and 4 are thereby each connected with the positive terminal of the power supply, such as the battery, of the vehicle whereas the electric motor 1 is connected to ground. Each working element 5, 6 and 7 is provided with an interior actuating element 5*a*, 6*a* and 7*a*, respectively in the form of an actuating knob.

In the position illustrated in the drawing, the central locking system is unlocked. The switch 3 is thereby in a position in which the positive terminal of the power supply is connected with the electric line 8 whereas the switch 9 of the electric motor 1 establishes a connection with the electric line 10 coordinated to the lower contact of the switch 3. If the interior actuating element 5*a* of the operating element 5 is now pressed downwardly in the sense of a locking, then the electric line 10 is connected with the positive terminal of the power supply and the electric motor 1 starts to run. The air pump 2 produces in this position a vacuum which now acts on the operating elements 5, 6 and 7 by way of the line system 11 and pulls the diaphragms thereof downwardly so that the doors (not shown) are locked. This vacuum also acts on a working element 12 coordinated to the motor pump unit, which, however, responds later than the working elements 5, 6, and 7 coordinated to the doors. As a result of the response of the working element 12, the motor 1 is now connected with the electric line 8 which is now without voltage and at the same time the air pump 2 is switched in a conventional manner (not shown) to the supply of vacuum. A pulling out of the interior actuating element 5*a* would now have as a consequence an unlocking of the doors.

In principle, these operations are also controllable by way of the working element 6 of the passenger front door and the switch 4 integrated therein.

However, when the key 14 is inserted in the ignition lock 13, the electric connecting line 16 is interrupted by way of a relay 15 so that the electric motor 1 cannot be influenced in the sense of a locking operation.

Only when with the ignition key 14 pulled out or removed, the relay 15 again connects the parts of the line 16 with each other, is the central locking system adapted to be fully influenced also by way of the actuating element 6*a* of the passenger front door.

The key 14 is inserted into the switch 13 to cause relay 15 to "pull in". The key switch 13 includes key sensing means in the form of contacts 13*a*, 13*b* and a spring-loaded switch arm 13*c* for sensing the presence and absence of the key 14. An enabling means constituted by the electrical path between contacts 15*a*–15*b* and switch arm 15*d* enables central locking only at driver door 5*b*. A disabling means to disable central locking at the passenger door 6*b* is constituted by the open circuit between contact 15*b* and switch arm 15*d*. A closed circuit between contacts 15*b*–15*c* and switch arm 15*d* constitutes central locking enabling means whereby central locking is enabled at both doors 5*b* and 6*b*. Locking knob 6*a* can be moved into the locked position directly from the inside or, by a second key, from the outside. As a result of the relay being pulled in, only the passenger door 6*a* is locked and the central locking system does not respond when the lock on this side of the vehicle is locked. When key 14 is withdrawn from the ignition switch on the steering wheel, relay 15 drops out, thereby interconnecting line 16 with passenger door switch 4 to enable operation of the central locking system from the passenger side. At this point, the vehicle can be centrally locked from the outside via 5*a* and 6*a*, or with the key 14.

The door lock buttons are actuated from the outside through an operating link between the lock cylinder and the door lock button via key 14. Operation of the central locking system at positioning element 5 is accomplished independently of interrogation of the lock on the steering wheel.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. In a central locking system with two-door control for motor vehicles having a starting switch, respective interior actuating means on a driver side and a passenger side, a driver door, a passenger door, and a key for said starting switch, and in which certain locking operations are precluded in dependence on the presence of the key of the starting switch, wherein the improvement comprises key sensing means for sensing the presence or absence of said key in said starting switch, enabling menas responsive to the presence of said key to enable a locking actuation of the central locking system exclusively by way of said interior actuating means on the driver side, disabling means also responsive to the presence of said key to disable a locking actuation of the central locking system on the passenger side and to permit a mechanical locking only of the passenger door by way of the interior actuating means on the passenger side, and central locking enabling means responsive to the absence of said key to enable a locking actuation of the central locking system by way of each interior actuating means on the driver and passenger sides.

2. A central locking system according to claim 1, which includes an air pump means driven by an electric motor, a pneumatic working element, wherein a relay means is arranged in an electric line leading from a switch means which is integrated in the pneumatic working element of the passenger door, to the electric motor, said relay means being operable to interrupt said electric line with the key inserted into the starting switch.

3. A central locking system according to claim 2, wherein the system is constructed as a bi-pressure installation with the air pump means driven by the electric motor.

* * * * *